US007659800B2

(12) United States Patent
Gruner et al.

(10) Patent No.: US 7,659,800 B2
(45) Date of Patent: Feb. 9, 2010

(54) ELECTROMAGNETIC RELAY ASSEMBLY

(76) Inventors: Philipp Gruner, 388 Hampshire La., Village of Lakewood, IL (US) 60014; Klaus A. Gruner, 1275 Broadway, Village of Lakewood, IL (US) 60014

( * ) Notice: Subject to any disclaimer, the term of this patent is extended or adjusted under 35 U.S.C. 154(b) by 126 days.

(21) Appl. No.: 11/980,040

(22) Filed: Oct. 30, 2007

(65) Prior Publication Data

US 2009/0033446 A1 Feb. 5, 2009

Related U.S. Application Data

(63) Continuation-in-part of application No. 11/888,519, filed on Aug. 1, 2007.

(51) Int. Cl.
*H01H 51/22* (2006.01)
*H01H 3/00* (2006.01)

(52) U.S. Cl. ..... 335/78; 335/185

(58) Field of Classification Search ..... 335/78, 335/83, 185

See application file for complete search history.

(56) References Cited

U.S. PATENT DOCUMENTS

| | | | | | |
|---|---|---|---|---|---|
| 4,743,877 | A | * | 5/1988 | Oberndorfer et al. | 335/128 |
| 5,568,108 | A | * | 10/1996 | Kirsch | 335/130 |
| 5,910,759 | A | * | 6/1999 | Passow | 335/78 |
| 5,933,065 | A | | 8/1999 | Duchemin | |
| 5,994,987 | A | * | 11/1999 | Passow | 335/78 |
| 6,020,801 | A | * | 2/2000 | Passow | 335/78 |
| 6,025,766 | A | * | 2/2000 | Passow | 335/78 |
| 6,046,660 | A | | 4/2000 | Gruner | |
| 6,046,661 | A | | 4/2000 | Reger et al. | |
| 6,246,306 | B1 | | 6/2001 | Gruner | |
| 6,252,478 | B1 | | 6/2001 | Gruner | |
| 6,292,075 | B1 | * | 9/2001 | Connell et al. | 335/185 |
| 6,320,485 | B1 | | 11/2001 | Gruner | |
| 6,426,689 | B1 | * | 7/2002 | Nakagawa et al. | 335/78 |
| 6,563,409 | B2 | | 5/2003 | Gruner | |
| 6,661,319 | B2 | * | 12/2003 | Schmelz | 335/78 |
| 6,788,176 | B2 | * | 9/2004 | Schmelz | 335/80 |
| 6,940,375 | B2 | * | 9/2005 | Sanada et al. | 335/86 |
| 6,949,997 | B2 | * | 9/2005 | Bergh et al. | 335/78 |
| 2006/0279384 | A1 | * | 12/2006 | Takayama et al. | 335/78 |

* cited by examiner

*Primary Examiner*—Elvin G Enad
*Assistant Examiner*—Alexander Talpalatskiy
(74) *Attorney, Agent, or Firm*—Meroni & Meroni, P.C.; Charles F. Meroni, Jr.; Christopher J. Scott

(57) ABSTRACT

An electromagnetic relay enables current to pass through switch termini and comprises a coil assembly, a rotor or bridge assembly, and opposing, balanced switch assemblies. The coil assembly comprises a coil and a C-shaped core. The coil is wound round a coil axis extending through the core. The core comprises core termini parallel to the coil axis. The bridge assembly comprises a bridge and a pair of actuators. The bridge comprises medial, lateral, and transverse field pathways. The actuators extend laterally from the lateral field pathway. The core termini are coplanar with the axis of rotation and received intermediate the medial and lateral field pathways. The actuators are cooperable with the switch assemblies. The coil creates a magnetic field directable through the bridge assembly via the core termini for imparting bridge rotation about the axis of rotation. The bridge rotation displaces the actuators for opening and closing the switch assemblies.

23 Claims, 17 Drawing Sheets

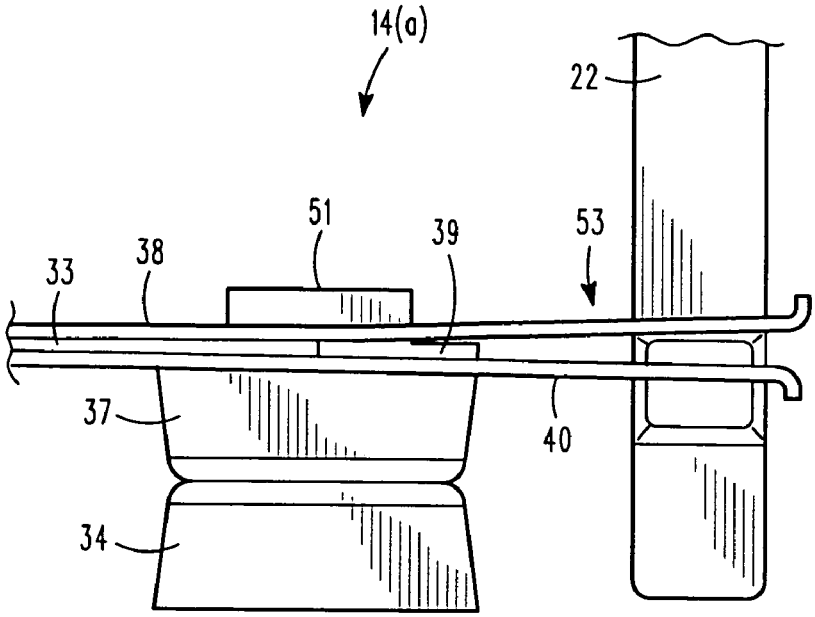
FIG. 15
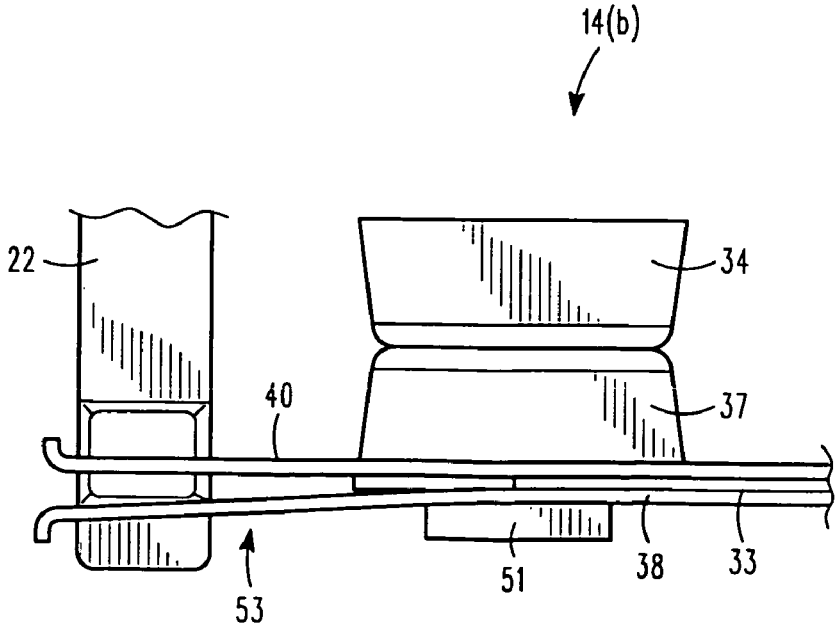

ELECTROMAGNETIC RELAY ASSEMBLY

PRIOR HISTORY

This application is a continuation-in-part patent application claiming the benefit of pending U.S. patent application Ser. No. 11/888,519 filed in the United States Patent and Trademark Office on Aug. 1, 2007.

BACKGROUND OF THE INVENTION

1. Field of the Invention

The disclosed invention generally relates to an electromagnetic relay assembly incorporating a uniquely configured armature assembly. More particularly, the disclosed invention relates to an electromagnetic relay assembly having a magnetically actuable rotor assembly for linearly displacing opposing switch actuators for selectively closing two switch mechanisms.

2. Brief Description of the Prior Art

Generally, the function of an electromagnetic relay is to use a small amount of power in the electromagnet to move an armature that is able to switch a much larger amount of power. By way of example, the relay designer may want the electromagnet to energize using 5 volts and 50 milliamps (250 milliwatts), while the armature can support 120 volts at 2 amps (240 watts). Relays are quite common in home appliances where there is an electronic control turning on (or off) some application device such as a motor or a light. The present teachings are primarily intended for use as a two pole, 200-amp passing electromagnetic relay assembly. It is contemplated, however, that the essence of the invention may be applied in other similarly constructed relay assemblies, having unique construction and functionality as enabled by the teachings of the two pole embodiment set forth in this disclosure. Several other electromagnetic relay assemblies reflective of the state of the art and disclosed in United States patents are briefly described hereinafter.

U.S. Pat. No. 6,046,660 ('660 patent), which issued to Gruner, discloses a Latching magnetic relay assembly with a linear motor. The '660 patent teaches a latching magnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin. Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

U.S. Pat. No. 6,246,306 ('306 patent), which issued to Gruner, discloses an Electromagnetic Relay with Pressure Spring. The '306 patent teaches an electromagnetic relay having a motor assembly with a bobbin secured to a housing. A core is adjacently connected below the bobbin except for a core end, which extends from the bobbin. An armature end magnetically engages the core end when the coil is energized. An actuator engages the armature and a plurality of center contact spring assemblies. The center contact spring assembly is comprised of a center contact spring which is not pre bent and is ultrasonically welded onto a center contact terminal. A normally open spring is positioned relatively parallel to a center contact spring. The normally open spring is ultrasonically welded onto a normally open terminal to form a normally open outer contact spring assembly. A normally closed outer contact spring is vertically positioned with respect to the center contact spring so that the normally closed outer contact spring assembly is in contact with the center contact spring assembly, when the center contact spring is not being acted upon by the actuator. The normally closed spring is ultrasonically welded onto a normally closed terminal to form a normally closed assembly. A pressure spring pressures the center contact spring above the actuator when the actuator is not in use.

U.S. Pat. No. 6,252,478 ('478 patent), which issued to Gruner, discloses an Electromagnetic Relay. The '478 patent teaches an electromagnetic relay having a motor assembly with a bobbin secured to a frame. A core is disposed within the bobbin except for a core end which extends from the bobbin. An armature end magnetically engages the core end when the coil is energized. An actuator engages the armature and a plurality of movable blade assemblies. The movable blade assembly is comprised of a movable blade ultrasonically welded onto a center contact terminal. A normally open blade is positioned relatively parallel to a movable blade. The normally open blade is ultrasonically welded onto a normally open terminal to form a normally open contact assembly. A normally closed contact assembly comprised of a third contact rivet and a normally closed terminal. A normally closed contact assembly is vertically positioned with respect to the movable blade so that the normally closed contact assembly is in contact with the movable blade assembly when the movable blade is not being acted upon by the actuator.

U.S. Pat. No. 6,320,485 ('485 patent), which issued to Gruner, discloses an Electromagnetic Relay Assembly with a Linear Motor. The '485 patent teaches an electromagnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin. Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

U.S. Pat. No. 6,563,409 ('409 patent), which issued to Gruner, discloses a Latching Magnetic Relay Assembly. The '409 patent teaches a latching magnetic relay assembly comprising a relay motor with a first coil bobbin having a first excitation coil wound therearound and a second coil bobbin having a second excitation coil wound therearound, both said first excitation coil and said second excitation coil being identical, said first excitation coil being electrically insulated from said second excitation coil; an actuator assembly magnetically coupled to both said relay motor, said actuator assembly having a first end and a second end; and one or two groups of contact bridge assemblies, each of said group of contact bridge assemblies comprising a contact bridge and a spring.

SUMMARY OF THE INVENTION

It is an object of the present invention to provide an electromagnetic relay assembly having certain means for damping contact vibration intermediate contacts of the switching assemblies. It is a further object of the present invention to provide an armature assembly having an axis of rotation and which rotates under the influence of the magnetic field created or imparted from an electromagnetic coil assembly. The armature assembly linearly displaces a two switch actuators for opening and closing the switch assemblies of the relay. To achieve these and other readily apparent objectives, the electromagnetic relay assembly of the present disclosure comprises an electromagnetic coil assembly, an armature bridge assembly, and first and second switch assemblies, as described in more detail hereinafter.

The coil assembly essentially comprises a coil, a C-shaped yoke assembly, and a coil axis. The coil is wound around the coil axis, and the yoke assembly comprises first and second yoke arms. Each yoke arm comprises an axial yoke portion that is coaxially alignable with the coil axis and together form the back of the C-shaped yoke assembly. Each yoke arm further comprises a yoke terminus, which yoke termini are coplanar and substantially parallel to the coil axis.

The armature bridge assembly is rotatable about an axis orthogonally spaced from the coil axis and coplanar with the yoke termini. The armature bridge assembly thus comprises a bridge axis of rotation, a bridge, and two actuator arms. The bridge comprises a medial field pathway relative closer in proximity to the coil axis, a lateral field pathway relatively further in proximity to the coil axis, and longitudinally or axially spaced medial-to-lateral or lateral-to-medial field pathways (or transverse field pathways) extending intermediate the medial and lateral pathways. The actuator arms are cooperable with the lateral field pathway via the first ends thereof and extend laterally away from the lateral field pathway.

The switch assemblies each essentially comprise switch terminals and a spring assembly between the switch terminals. The spring assemblies are is attached second ends of the actuator arms. The yoke termini are received intermediate the medial and lateral pathways. As is standard and well-established in the art, the coil receives current and creates or imparts a magnetic field, which magnetic field is directable through the bridge assembly via the yoke termini for imparting bridge rotation about the bridge axis of rotation and linearly displacing the actuator arms. The displaceable actuator arms function to actuate the spring assemblies intermediate an open contact position and a closed contact position, which closed contact positions enables current to pass through the switch assemblies via the switch termini.

Certain peripheral features of the essential electromagnetic relay assembly include certain means for enhancing spring over travel, which means function to increase contact pressure intermediate the switch terminals when the spring assemblies are in the closed position. The means for enhancing spring over travel further provide means for contact wiping or contact cleansing via the enhanced contact or increased contact pressure. In other words, the enhanced conduction path through the contact interface may well function to burn off residues and/or debris that may otherwise come to rest at the contact surfaces. The means for enhancing spring over travel may well further function to provide certain means for damping contact bounce or vibration intermediate the first and second contacts when switching from the open position to the closed position.

Other objects of the present invention, as well as particular features, elements, and advantages thereof, will be elucidated or become apparent from, the following description and the accompanying drawing figures.

BRIEF DESCRIPTION OF THE DRAWINGS

Other features of our invention will become more evident from a consideration of the following brief description of patent drawings:

FIG. 2(*a*) is a fragmentary enlarged sectional view as sectioned from the assembly depicted in FIG. 2 showing the rotor assembly and rotor mount.

FIG. 15 is a dual fragmentary side view depiction of opposed, preferred triumvirate spring assemblies, contact buttons, and armature arm assemblies of the present invention showing the contact buttons in a closed position showing the respective triumvirate spring assemblies such that two springs are in a substantially linear configuration and one spring is in an offset configuration before over travel.

DETAILED DESCRIPTION OF THE PREFERRED EMBODIMENT

Figure 1:
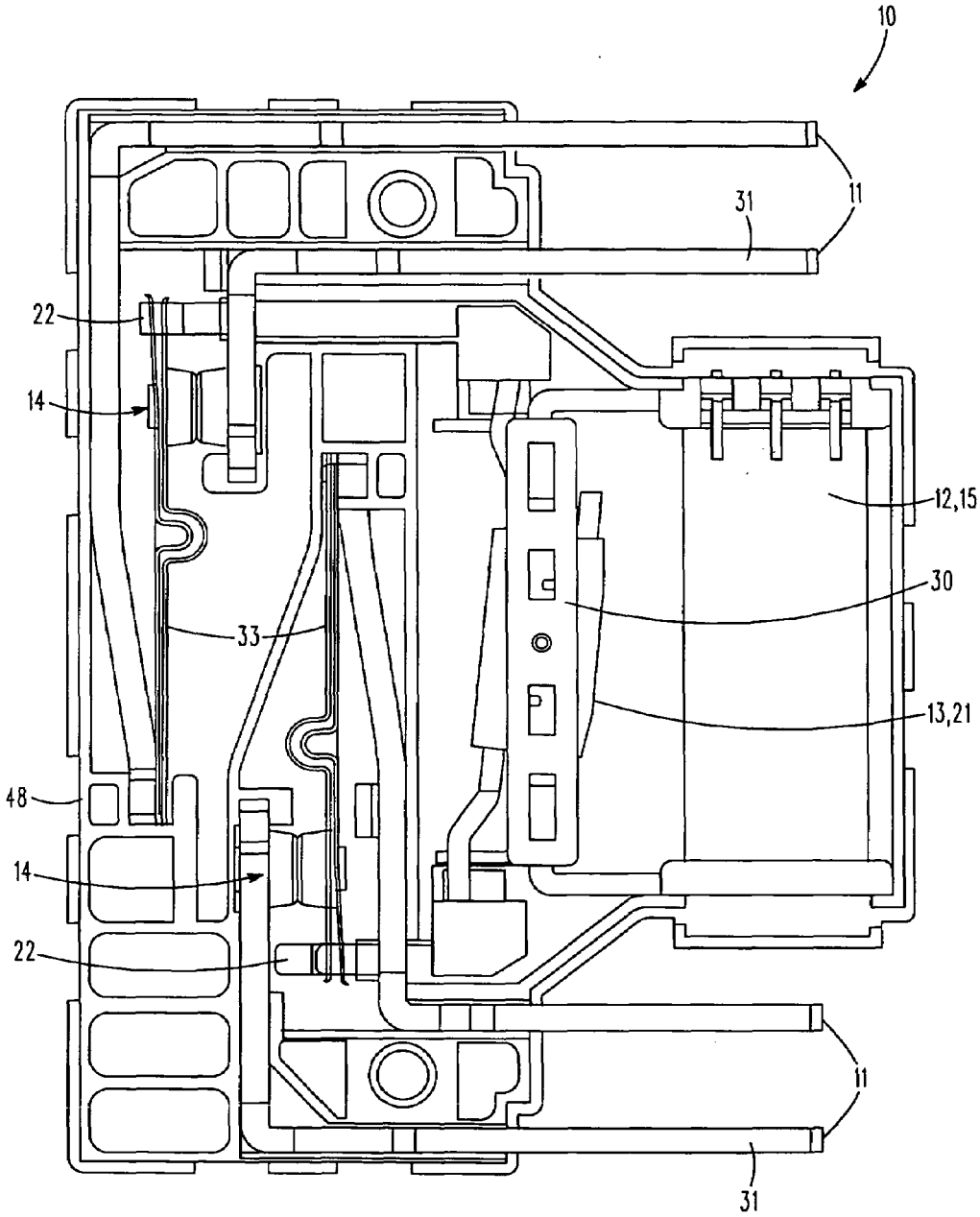
FIG. 1 is a first top plan view of the electromagnetic relay assembly of the present invention with cover removed and first and second switch assemblies in a closed position.
Figure 2:
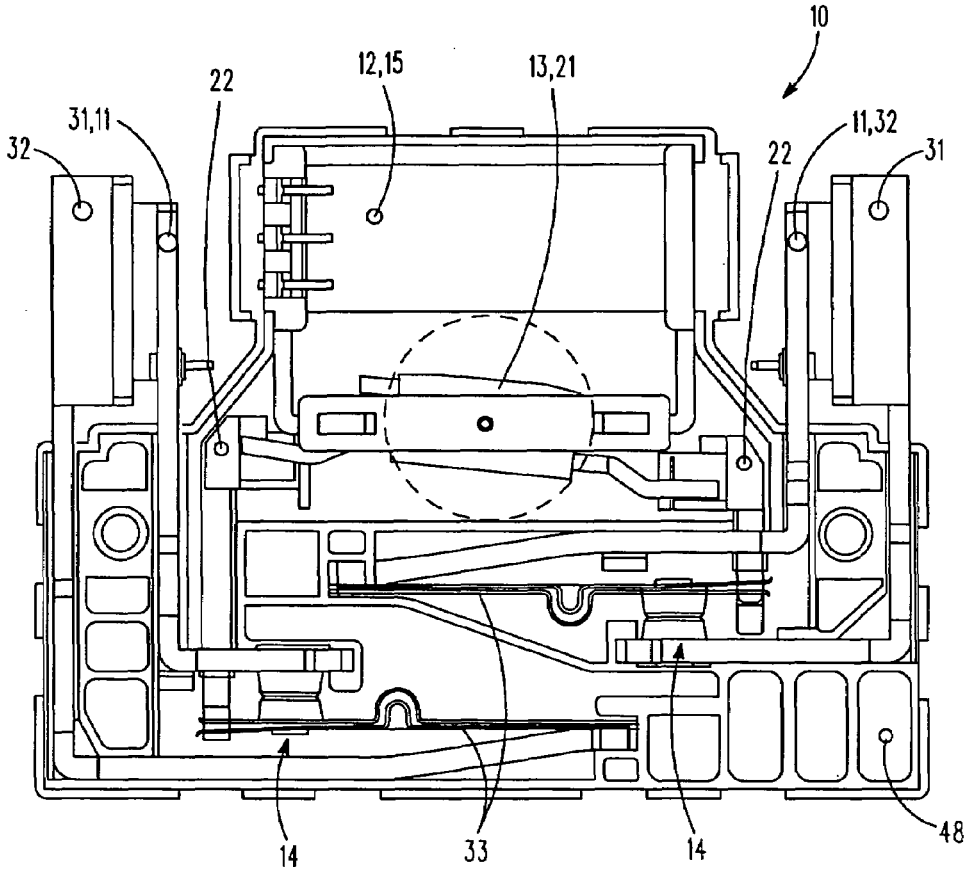
FIG. 2 is a second top plan view of the electromagnetic relay assembly of the present invention with cover removed and the first and second switch assemblies in a closed position.
Figure 2A:
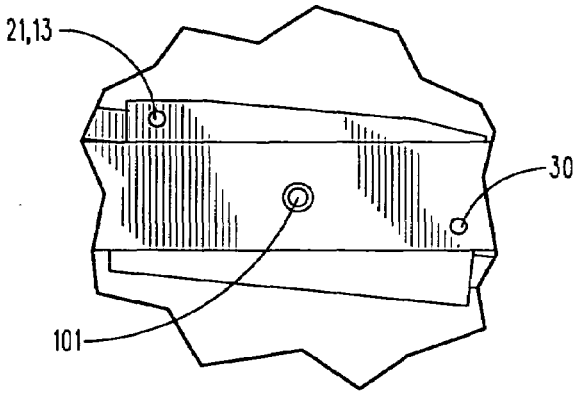
Figure 4:
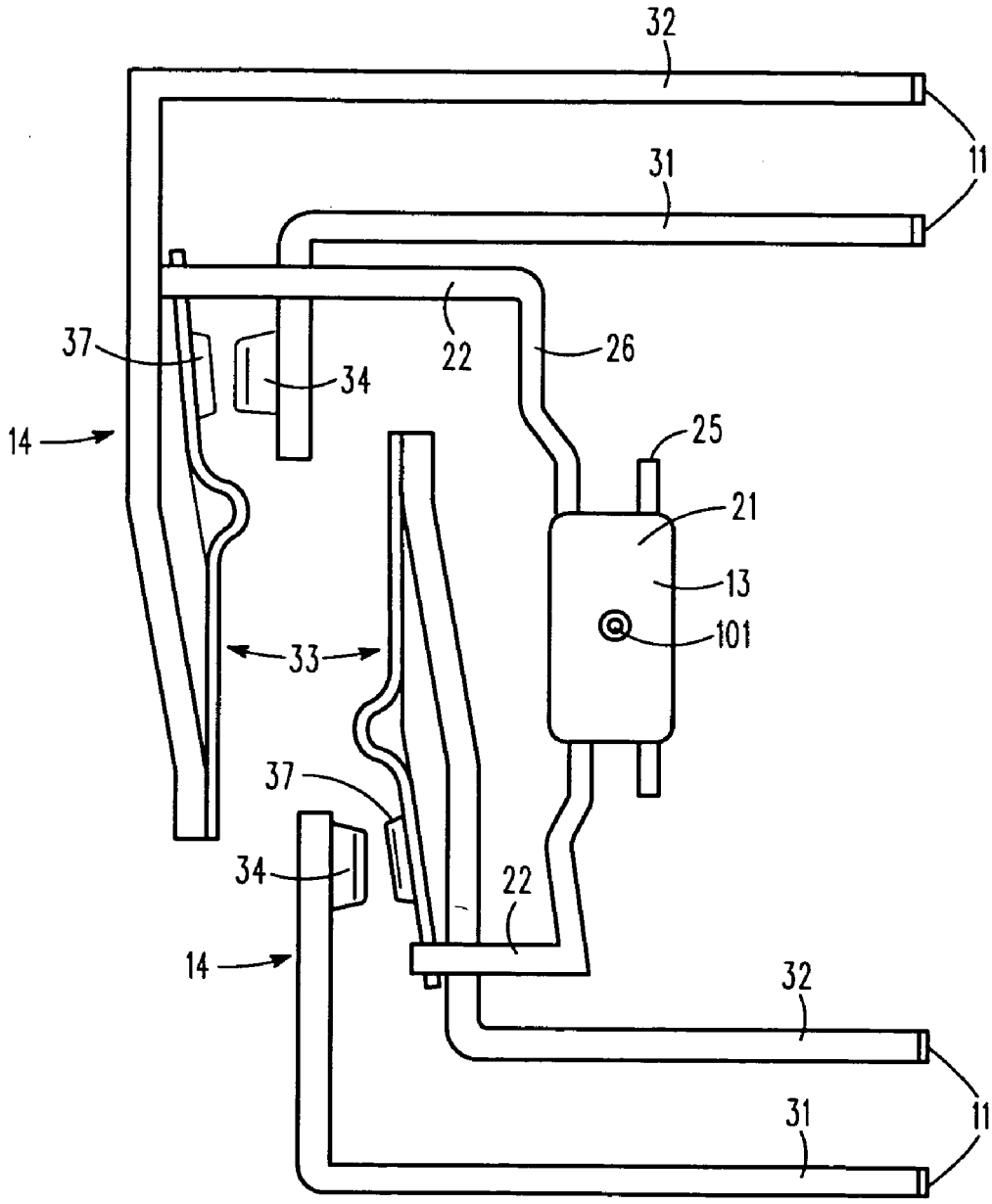
FIG. 4 is a diagrammatic plan type depiction of the rotor assembly, actuator arms, and switch assemblies in an open position as separated from the relay housing and coil assembly for enhancing understanding of the structural relationship therebetween.
Figure 5:
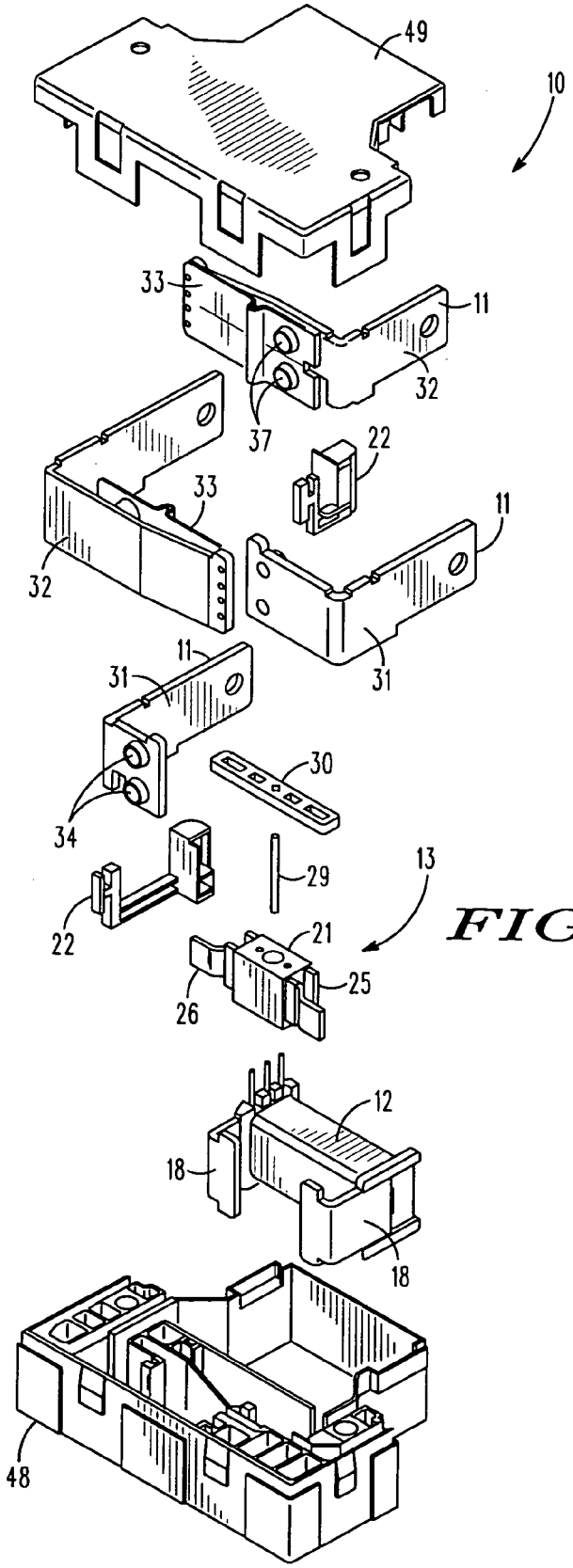
FIG. 5 is an exploded top perspective view of a relay assembly according to the present invention.

Referring now to the drawings with more specificity, the preferred embodiment of the present invention concerns an two-pole electromagnetic relay assembly 10 as generally illustrated and referenced in FIGS. 1, 2, and 5. The electromagnetic relay assembly 10 of the present invention essentially functions to selectively enable current to pass through two sets of switch termini 11. The switch termini 11 are illustrated and referenced in FIGS. 1, 2, 3-5, and 8-11. To achieve these and other readily apparent functions, the two-pole electromagnetic relay assembly 10 of the present invention preferably comprises an electromagnetic coil assembly 12 as generally illustrated and referenced in FIGS. 1, 2, 5, and; a rotatable armature assembly 13 as generally illustrated and referenced in FIGS. 1-5; and first and second switch assemblies 14 as generally illustrated and referenced in FIGS. 1, 2, 3, and 4.

Figure 6:
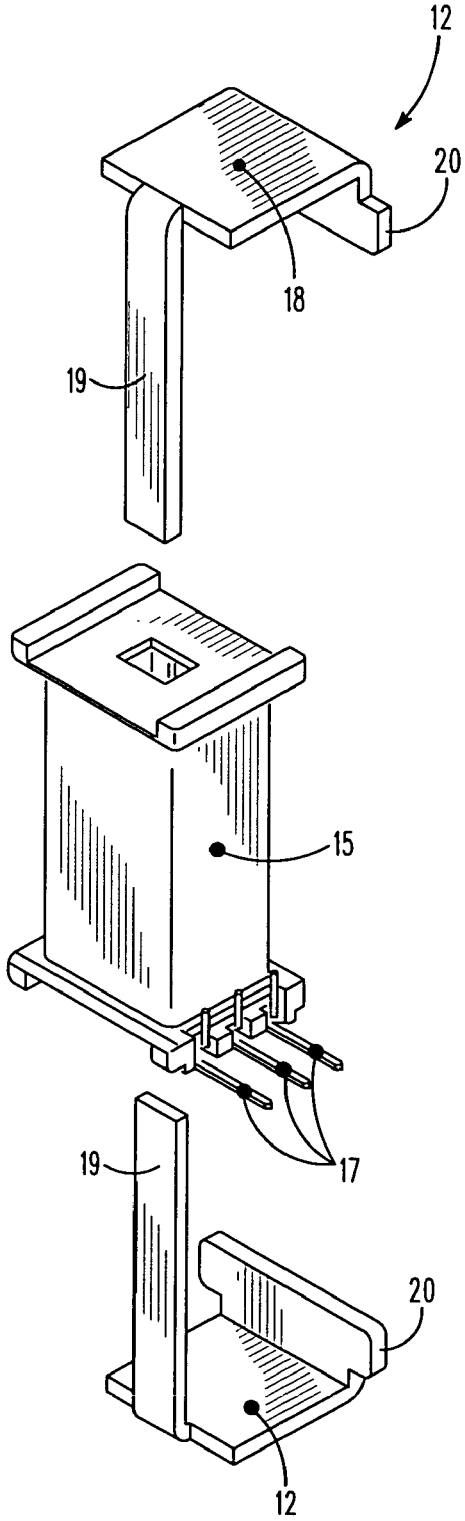
FIG. 6 is an exploded perspective view of the coil assembly according to the present invention.
Figure 17:
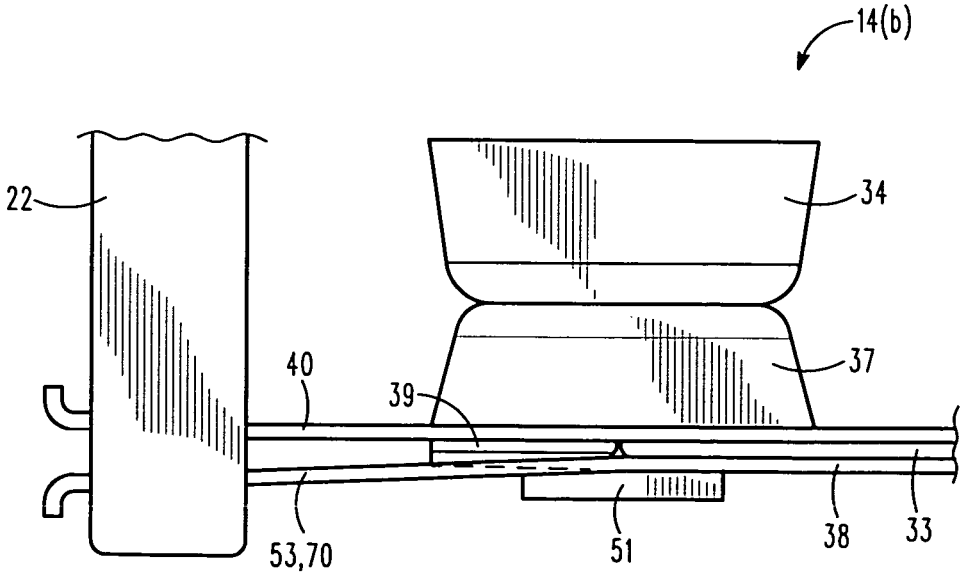
FIG. 17 is an enlarged fragmentary side view depiction of the junction at the left most triumvirate spring assembly and the upper contact button otherwise shown in FIG. 15 depicting the spring with offset before over travel.
Figure 18:
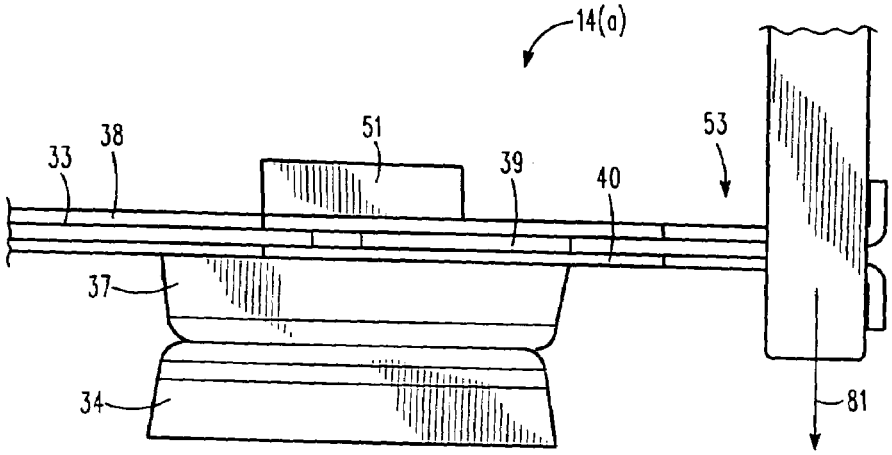
FIG. 18 is an enlarged fragmentary side view depiction of the junction of the triumvirate spring assembly and the upper contact button otherwise shown in FIG. 16 depicting the spring with offset after over travel.
Figure 19:
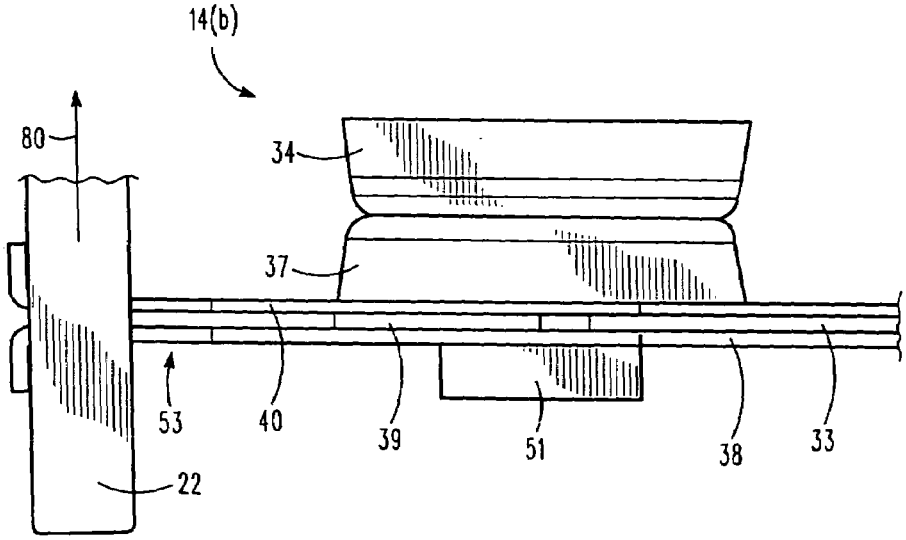
FIG. 19 is an enlarged fragmentary side view depiction of the junction of the triumvirate spring assembly and the upper contact button otherwise shown in FIG. 17 depicting the spring with offset after over travel.
Figure 20:
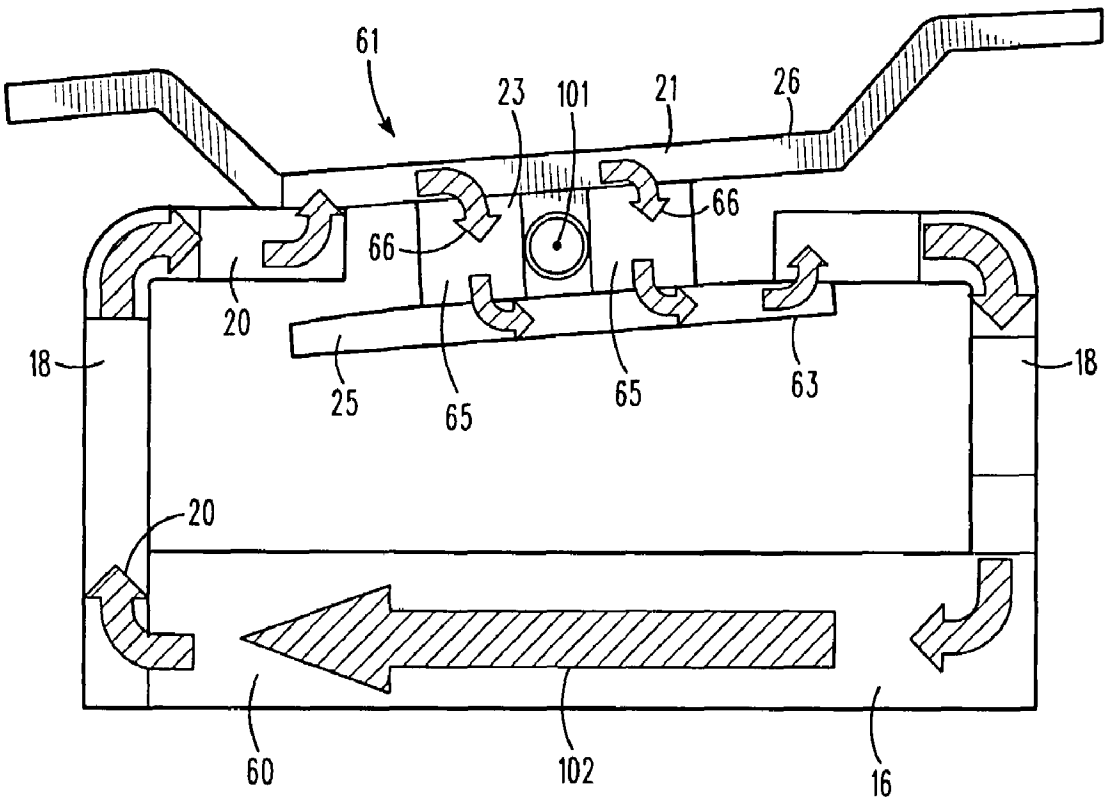
FIG. 20 is a diagrammatic depiction of the flux flow through the C-shaped core assembly and the rotor assembly of the electromagnetic relay assembly depicting a diverted and divided field flow through the rotor assembly.

The coil assembly 12 of the relay 10 preferably comprises a current-conductive coil 15 as illustrated and referenced in FIGS. 1, 2, and 6; a C-shaped core or yoke assembly 16 as illustrated in exploded form in FIG. 6 and illustrated in diagrammatic form in FIG. 15; and a longitudinal coil axis. It may be seen or understood from an inspection of the noted figures that the current-conductive coil 15 is wound around the coil axis and comprises certain electromagnet-driving termini 17 as illustrated and referenced in FIG. 6. The yoke assembly or C-shaped core assembly 16 of the present invention is axially received within the coil 15 and preferably comprises first and second yoke arms 18 as illustrated and referenced in FIGS. 5 and 6 and as diagrammatically depicted in FIGS. 15 and 17. It may be seen from an inspection of FIG. 6 that the yoke arms 18 each comprise an axial yoke portion 19 and a substantially planar yoke terminus 20, which yoke termini 20 are preferably parallel to the coil axis when in an assembled state.

Figure 7:
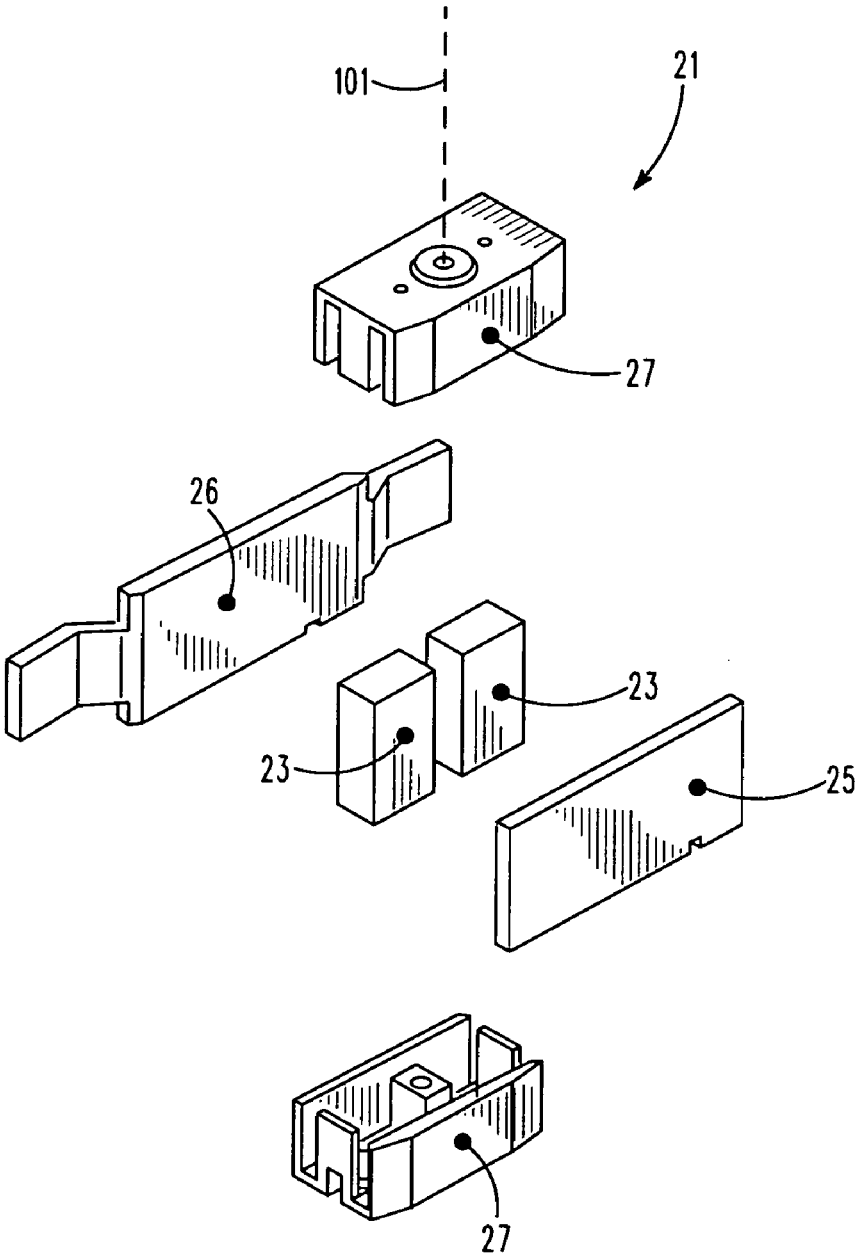
FIG. 7 is an exploded perspective view of the rotor assembly according to the present invention.
Figure 8:
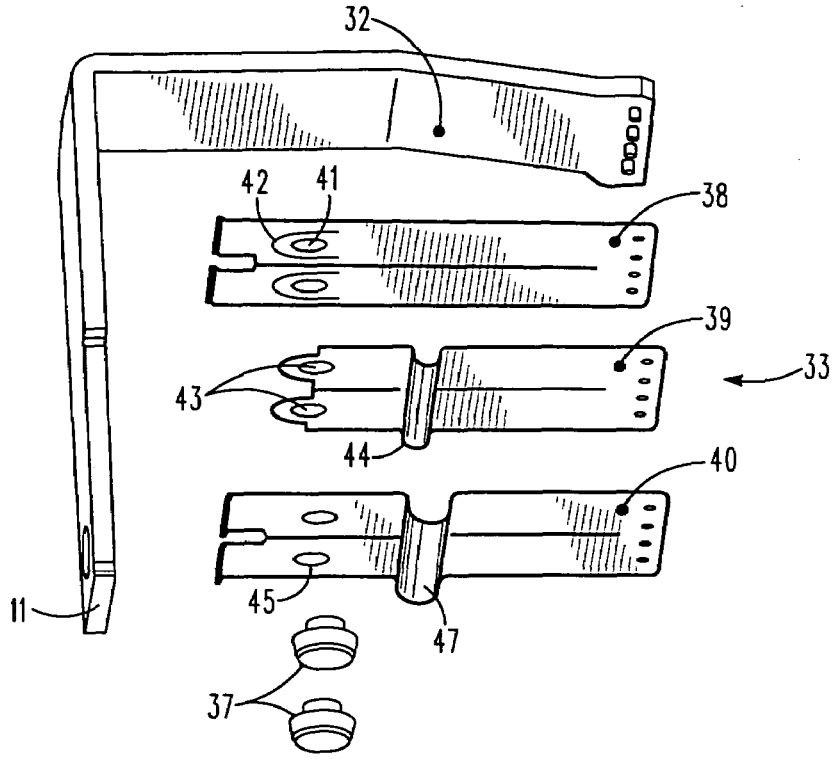
FIG. 8 is an exploded perspective view of a first type of first switch terminal assembly and triumvirate spring assembly with contact buttons according to the present invention.
Figure 9:
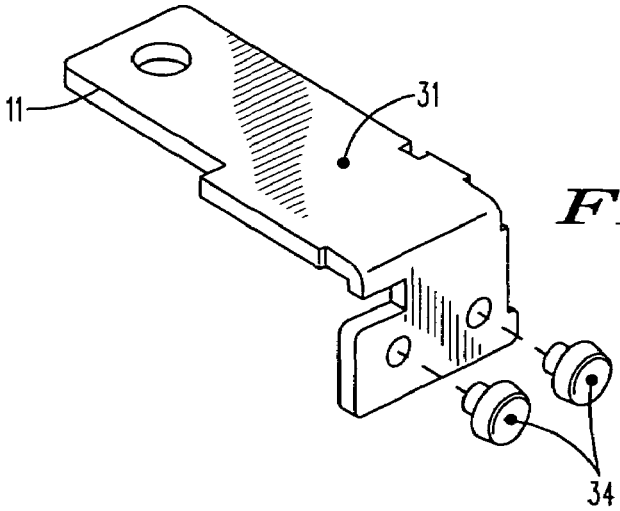
FIG. 9 is an exploded perspective view of a second type of second switch terminal assembly with contact buttons according to the present invention.
Figure 10:
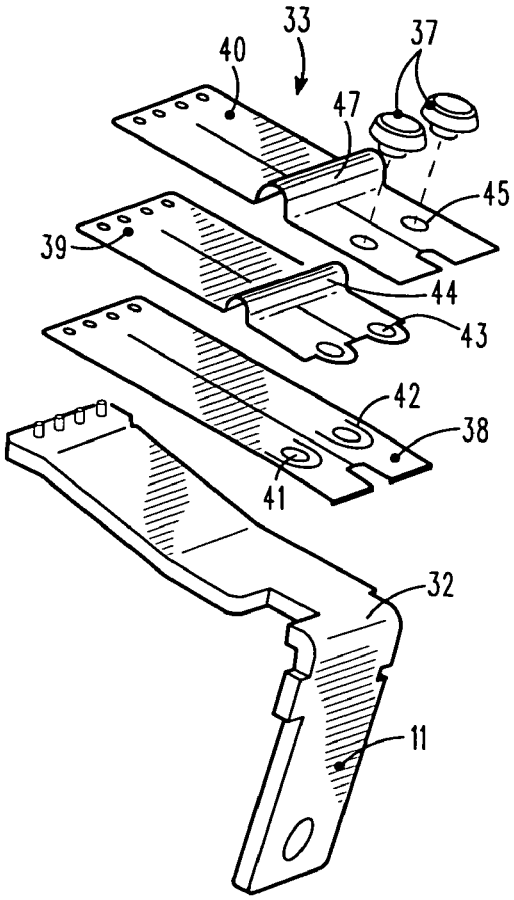
FIG. 10 is an exploded perspective view of a second type of first switch terminal assembly and triumvirate spring assembly with contact buttons according to the present invention.
Figure 11:
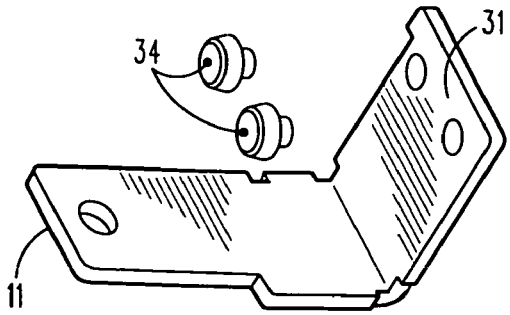
FIG. 11 is an exploded perspective view of a second type of second switch terminal assembly with contact buttons according to the present invention.
Figure 12:
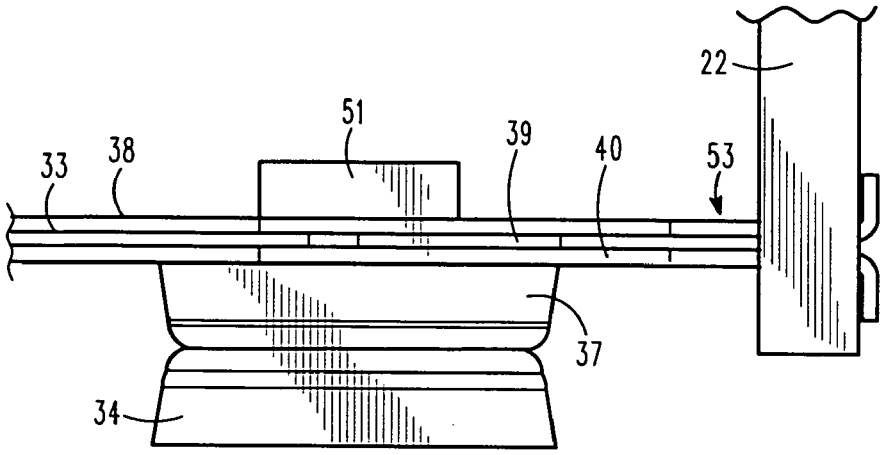
FIG. 12 is a fragmentary side view depiction of an alternative triumvirate spring assembly, the contact buttons, and an armature arm of the present invention showing the contact buttons in a closed position with the triumvirate spring assembly in a substantially linear configuration before over travel.
Figure 13:
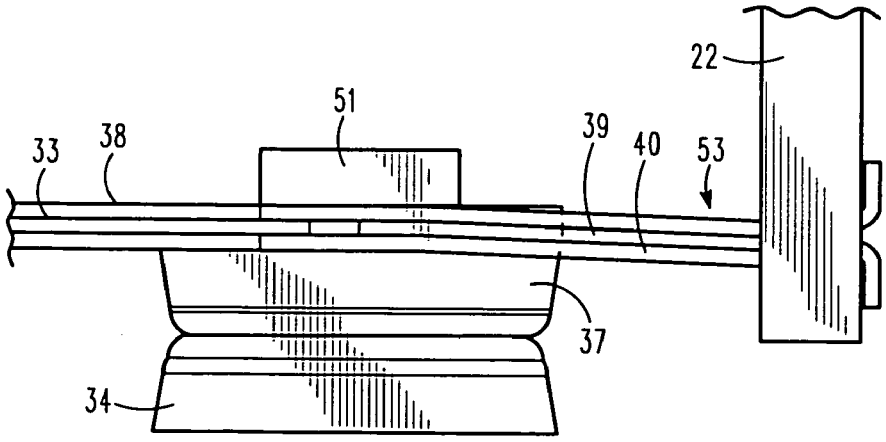
FIG. 13 is a fragmentary side view depiction of the triumvirate spring assembly, contact buttons, and armature arm otherwise depicted in FIG. 12 showing the contact buttons in a closed position with the triumvirate spring assembly in an over travel position for enhancing contact pressure intermediate the contact buttons.
Figure 14:
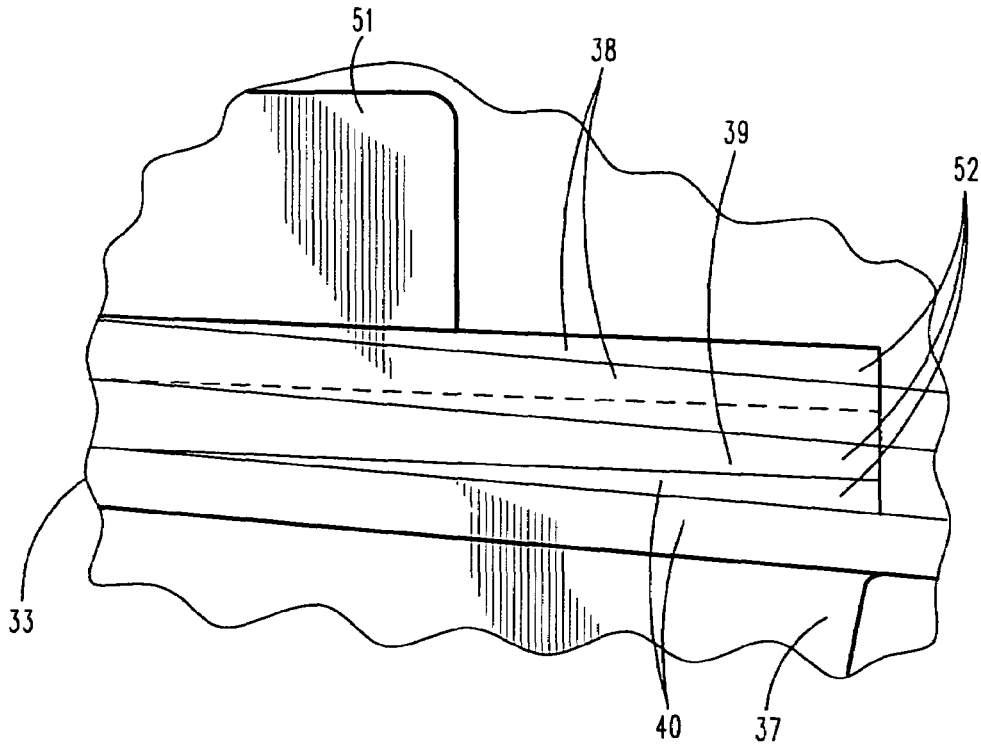
FIG. 14 is an enlarged fragmentary side view depiction of the junction at the triumvirate spring assembly and the upper contact button otherwise shown in FIG. 13 depicting the triumvirate spring assembly in the over travel position for enhancing contact pressure intermediate the contact buttons.
Figure 16:
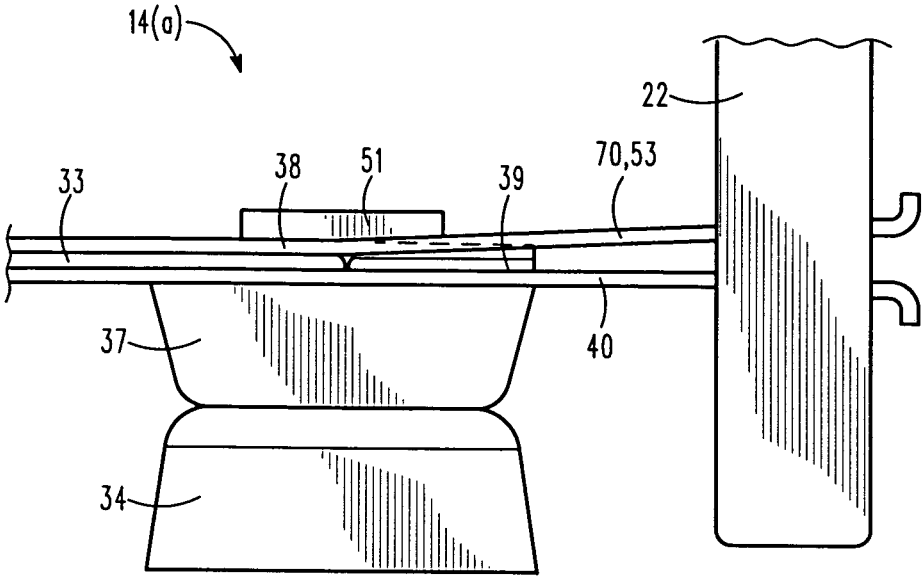
FIG. 16 is an enlarged fragmentary side view depiction of the junction at the right most triumvirate spring assembly and the upper contact button otherwise shown in FIG. 15 depicting the spring with offset before over travel.

The rotatable armature assembly 13 of the present invention may be described as preferably comprising a rotor assembly 21 as generally illustrated and referenced in FIGS. 1-5, 7, 15, and 17; first and second actuators or actuator arms 22 as generally illustrated and referenced in FIGS. 1, 2, 3-5, and 13; and an armature axis of rotation 101 as depicted and referenced at a point in FIGS. 2(*a*)-4, 15, and 17, and as a broken line in FIG. 7. The rotor assembly 21 preferably comprises first and second uniformly directed or polarized rotor magnets 23 as illustrated and referenced in FIGS. 7 and 15; a rotor plate 25 as illustrated and referenced in FIGS. 3-5, 7, and 15; a rotor bracket 26 as illustrated and referenced in FIGS. 3-5, 7, and 15; a rotor housing 27 as illustrated in exploded form in FIG. 7; a rotor pin 29 as illustrated and referenced in FIG. 5; and a rotor mount 30 as illustrated and referenced in FIGS. 1, 2(*a*), and 5.

It may be seen from an inspection of the noted figures that the rotor bracket 26 is attached or otherwise cooperatively associated with first ends of the actuator arms 22, and that the rotor plate 25 and the rotor bracket 26 (or portions thereof) are preferably oriented parallel to one another by way of the rotor housing 27. It will be seen that the terminal ends of rotor bracket 26 are zigzagged or zigzag extend from the central portion of the rotor bracket 26, which central portion is parallel to the rotor plate 25. The terminal ends of the rotor bracket 26, as zigzag extended from, and integrally formed with the rotor bracket 26, attach the rotor bracket 26 to the actuator arms 22.

It may be further seen that the first and second rotor magnets 23 are equally dimensioned and extend intermediate the rotor plate 25 and the central portion of the rotor bracket 26 for simultaneously and equally spacing the rotor plate 25 and the central portion of the rotor bracket 26 and for further providing a guide way or pathway for so-called Lorenz current or magnetic flux to be effectively transversely directed across the rotor or bridge assembly 21 as diagrammatically depicted in FIG. 15.

In this last regard, it is contemplated that the armature assembly 13 may be thought of as an armature bridge assembly, which bridge assembly comprises a bridge axis of rotation (akin to the armature axis of rotation 101) and a bridge in cooperative association with the armature arms 22. In this context, the bridge may be thought of or described as preferably comprising a medial pathway (akin to the rotor plate 25), a lateral pathway (akin to the rotor bracket 26), and longitudinally or axially spaced medial-to-lateral or transverse pathways (akin to the first and second rotor magnets 23. The armature arms 22 may thus be described as extending laterally away from the lateral pathway or rotor bracket 26 for engaging the switch assemblies 14.

The rotor housing 27 essentially functions to receive, house, and position the first and second rotor magnets 23, the rotor plate 25 and the rotor bracket 26 to form the bridge like structure of the armature assembly 13. The rotor magnets 23 are uniformly directed such that like poles face the same rotor structure. For example, it is contemplated that the north poles of rotor magnets 23 may face the rotor bracket 26 (the south poles thereby facing the rotor plate 25) or that the south poles of rotor magnets 23 may face the rotor bracket 26 (the north poles thereby facing the rotor bracket).

The rotor housing 27 may well further comprise a pin-receiving aperture or bore receiving the rotor pin 29. The pin-receiving bore of the rotor housing 27 enables rotation of the bridge or armature assembly 13 about the armature axis of rotation 101. The rotor pin 29, extending through the pin-receiving bore, may be axially anchored at a lower end thereof by way of a relay housing 48 as illustrated and referenced in FIGS. 1-3, and which relay housing 48 is sized and shaped to receive, house, and position the coil assembly 12, the armature assembly 13, and the switch assemblies 14. It may be further readily understood from an inspection of FIG. 5 that the relay housing 48 may, but not necessarily, comprise or be cooperable with a relay cover 49.

In this last regard, it will be recalled that the armature assembly 13 of present invention may be anchored or mounted by way of the rotor mount 30. Rotor mount 30 may be cooperatively associated with the relay housing 48 (i.e. anchored to the relay housing 48) for axially fixing the rotor pin 29, the fixed rotor mount 30 receiving and anchoring an upper end of the rotor pin 29 so as to enable users of the relay to effectively operate the electromagnetic relay assembly 10 without the relay cover 49. The rotor or bridge mount 30 or means for mounting the rotor assembly or bridge assembly may thus be described as providing certain means for enabling open face operation of the electromagnetic relay assembly 10. It is contemplated, for example, that in certain scenarios a coverless relay assembly provides a certain benefit. For example, the subject relay assembly may be more readily observed during testing procedures. In any event, it is contemplated that the rotor mount 30 of the present invention enables cover-free operation of the electromagnetic relay assembly 10 by otherwise fixing the armature assembly 13 to the relay housing 48.

The switch assemblies 14 of the present relay assembly 10 each preferably comprise a first switch terminal assembly 31 as generally illustrated and referenced in FIGS. 1, 2, 3-5, 9, 11, and 17; a second switch terminal assembly 32 as illustrated and referenced in FIGS. 1, 2, 3-5, 8, 10, 16, and 17; and a triumvirate spring assembly 33 as illustrated and referenced in FIGS. 1, 2, 3-5, 8, 10, 12, 14, and 16. From an inspection of the noted figures, it may be seen that each first switch terminal assembly 31 preferably comprises a first set of contact buttons 34 and a first switch terminus as at 11. Further, the second switch terminal assemblies 32 each preferably comprise a second switch terminus as at 11.

Figure 21:
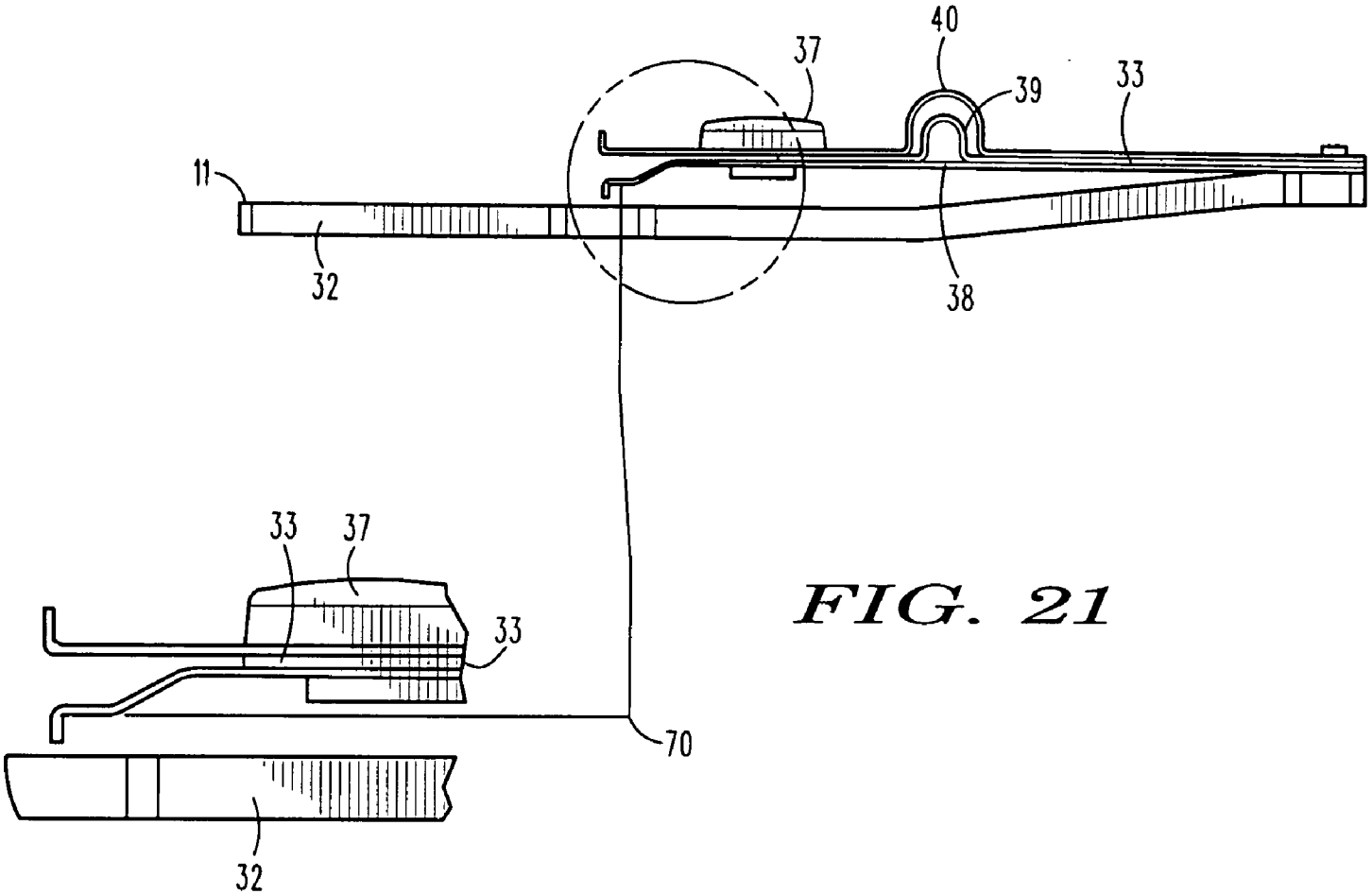
FIG. 21 is a dual side view depiction of a switch terminal assembly showing (1) the assembly as operatively connected to a triumvirate spring assembly and a contact button, the triumvirate spring assembly showing first and second springs with centrally located C-shaped folds, and a third spring with an end-located bend, and (2) an enlarged fragmentary sectional view depicting the end-located bend of the third spring in greater detail.
Figure 22:
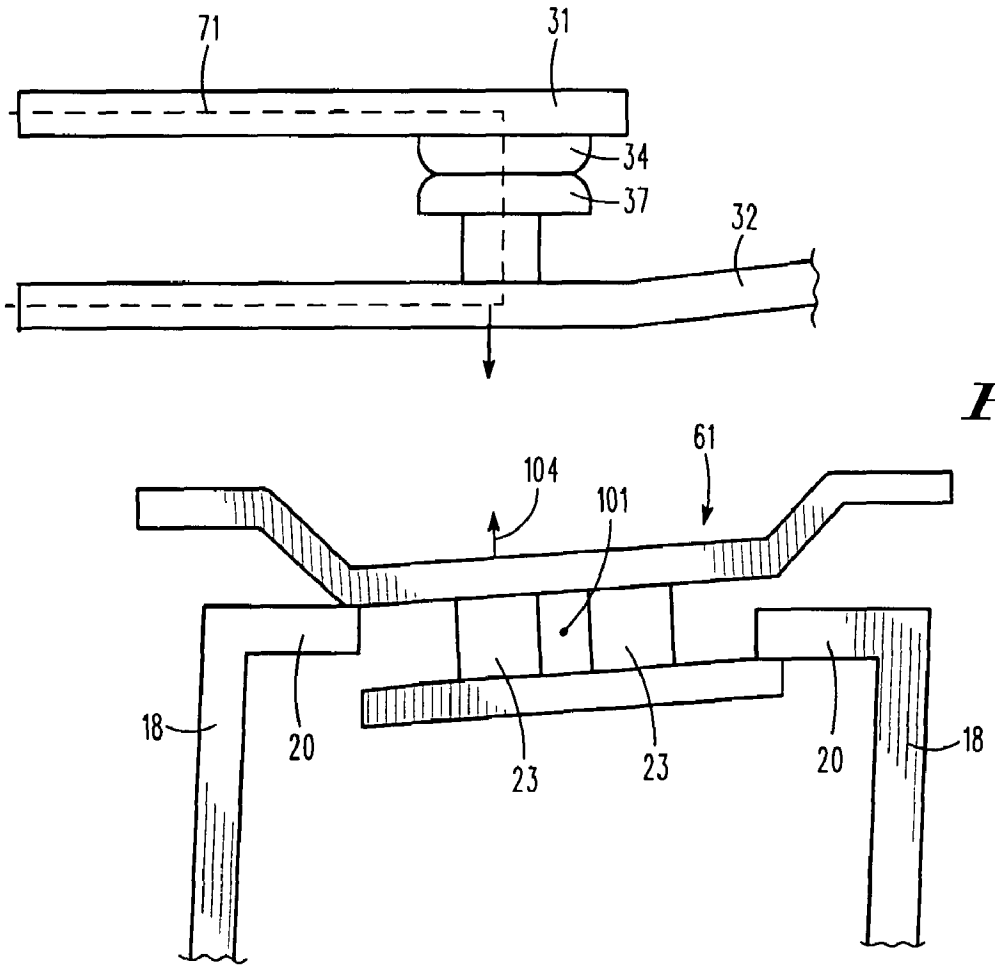
FIG. 22 is a diagrammatic depiction of a threshold current path directed through the relay terminals as disposed in adjacency to the rotatable armature assembly and depicting a terminal-sourced magnetic field greater in magnitude than an armature-sourced magnetic field for rotating the armature assembly toward a circuit-opening position.

The triumvirate spring assemblies 33 each preferably comprises a second set of contact buttons 37; and a first spring 38, a second spring 39, and a third spring 40 as further illustrated and referenced in FIGS. 8, 10, 12-14, and 16. It may be further seen that the first springs 38 each preferably comprises a first set of contact-receiving apertures as at 41 and a first set of C-shaped apertures as at 42 in FIGS. 8 and 10, as well as an end-located offset or bend as at 70 in FIGS. 16, 17, and 21. The offset or bend 70 is relatively more abbreviated in FIG. 21 for clarity of inspection. Notably, the first C-shaped aperture 42 is preferably concentric about the first contact-receiving aperture 41. The second springs 39 each preferably comprise a second set of contact-receiving apertures as at 43 and a first C-shaped fold or bend as at 44 in FIGS. 8 and 10. It may be seen from an inspection of FIGS. 8 and 10 that the first C-shaped fold or bend 44 has a certain first radius of curvature. The third springs 40 each preferably comprises a third set of contact-receiving apertures as at 45, and a second C-shaped fold as at 47.

It may be further seen that the second C-shaped fold 47 has a certain second radius of curvature, which second radius of curvature is greater in greater in magnitude than the first radius of curvature (of the first C-shaped fold 44). The second springs 39 are sandwiched intermediate the first and third springs 38 and 40 via the second contact buttons 37 as received or extended through the contact-receiving apertures 41, 43, and 45. The first C-shaped folds 44 are concentric (about a fold axis) within the second C-shaped folds 47. The first and second contact buttons 34 and 37 or contacts are spatially oriented or juxtaposed adjacent one another as generally depicted in FIGS. 1, 2, 3, 4, 12-14, and 17. In the preferred embodiment, the triumvirate spring assemblies 33 are biased in an open contact position intermediate the first and second switch termini 11 and attached to (the lateral end of) the armature arms 22.

It is contemplated that the first and second C-shaped apertures 42, and the end-located offset or bends 70 may well function to provide certain means for enhanced over travel for increasing contact pressure intermediate the contact buttons 34 and 37. Notably, the third springs 40 do not have a C-shaped aperture or cut out, in contradistinction to the preferred embodiments set forth in U.S. patent application Ser. No. 11/888,519, filed in the United States Patent and Trademark Office on Aug. 1, 2007, from which this specification claims priority and which specification is hereby incorporated by reference thereto insofar as the subject matter here presented is supported by common matter therebetween. In the two-pole relay 10 of the present invention, the third spring 40 needs only flex more in a single direction due to the balanced, opposing spring assembly 14 set-up. In other words, the cut outs or apertures 42 on springs 38 allow for more over travel in opposing directions, which is not necessarily required in the opposite direction.

In this last regard, the reader is directed to FIGS. 12-14 and FIGS. 15-19, respectively. From a consideration of FIGS. 12-14, it may be seen that the terminal side ends 53 of the spring assembly 33 may be actuated past the planar portions of the spring assembly 33 immediately adjacent the stem 51 of contact button 37. The planar portions of the spring assembly 33 immediately (and radially) adjacent the stem 51 of contact button 37 thus form button-stackable spring portions as at 52 in FIG. 14. It may be seen that the button-stackable portions 52 stack upon the contact button 37 and that terminal side ends 53 of the elastically deform as at 50 for enabling said over travel. From a comparative consideration of FIGS. 15-19 (and referencing the push-closed switch assembly 14(*a*) versus the pull-closed switch assembly 14(*b*)), it may be seen that terminal side ends 53 of the springs 38 (comprising the offset or bends 70) of the spring assemblies 33 may be actuated into a substantially planar configuration immediately adjacent the stem 51 of contact buttons 37.

The material (preferably copper) of the spring elements having the C-shaped apertures is more readily and elastically deformable at the termini of the C-shaped apertures as at 50. Notably, the elastic deformation of the material adjacent termini 50 does not result in appreciable embrittlement of the underlying material lattice (i.e. does not appreciably impart undesirable lattice dislocations) and thus the C-shaped aperture structure or feature of the triumvirate spring assembly provides a robust means for enhanced over travel for further providing certain added pressure intermediate the contact buttons 34 and 37 for improving conductive contact(s) therebetween. The end-located offset or bends 70, located on springs 38, provide further means for enhanced over travel for increasing contact pressure and reducing contact bounce of the contacts 34 and 37.

Figure 3:
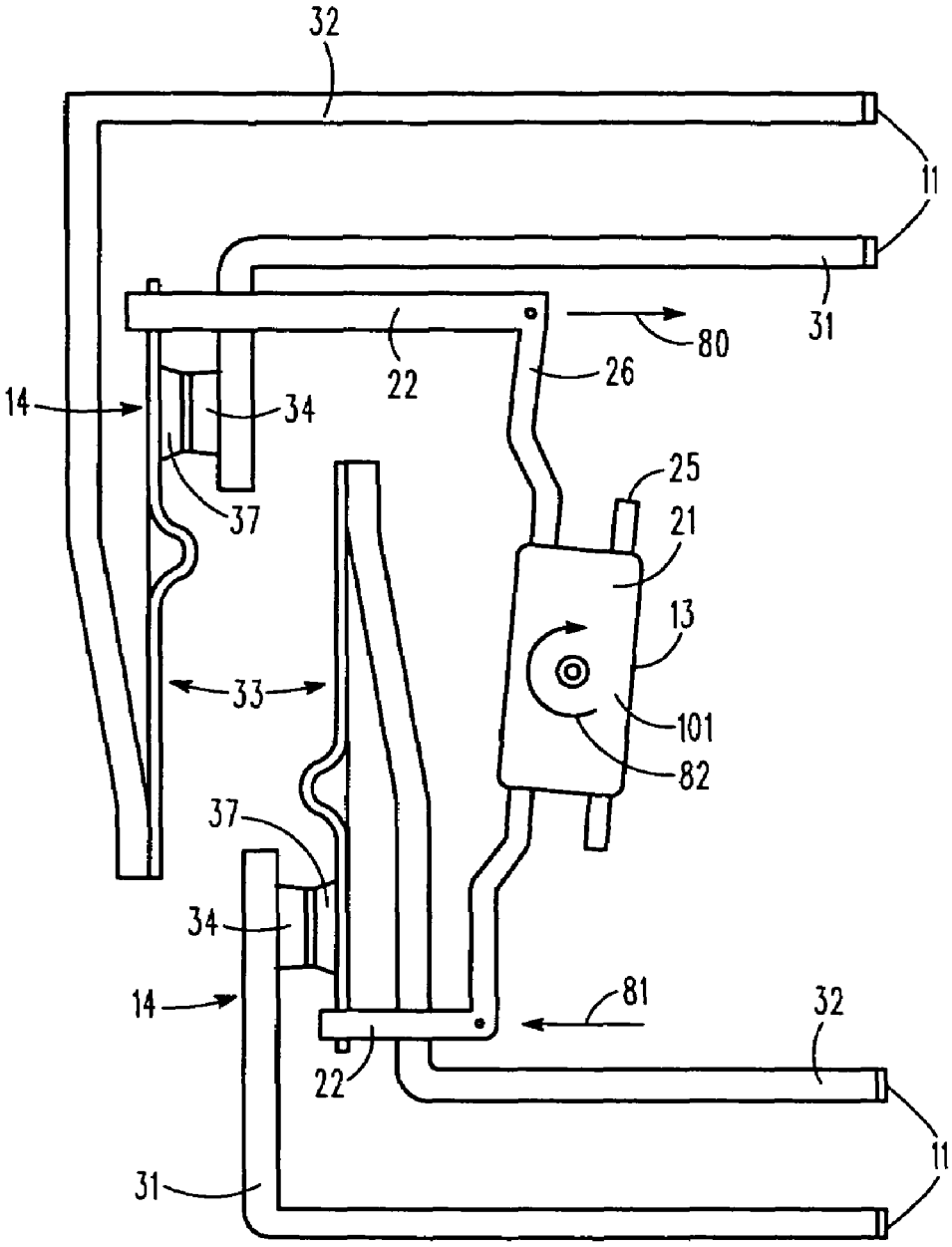
FIG. 3 is a diagrammatic plan type depiction of the rotor assembly, actuator arms, and switch assemblies in a closed position as separated from the relay housing and coil assembly for enhancing understanding of the structural relationship therebetween.

Conduction through the contact buttons 34 and 37 is thus improved by way of the C-shaped aperture-enabled and/or enhanced over travel. It is contemplated that the enhanced contact and resulting conduction provides certain means for improved contact wiping, said means for contact wiping or contact cleansing thus being further enabled by way of the enhanced over travel. In this regard, it is contemplated that the relay assembly 10 of the present invention inherently has a self-cleansing feature as enabled by the C-shaped apertures 42. Further, it is contemplated that the C-shaped apertures 42 (and offset or bend 70) may well provide certain means for reducing contact bounce or for otherwise damping contact vibration intermediate the contact buttons 34 and 37 when switching from an open contact state or open switch position (as generally depicted in FIG. 4) to a closed contact state or closed switch position (as generally depicted in FIGS. 1, 2, and 3).

From an inspection of FIG. 15, it may be readily understood that the core or yoke termini 20 are loosely received intermediate the rotor plate 25 and the rotor bracket 26, and that the armature axis of rotation 101 is coplanar with the yoke termini 20, which axis of rotation 101 extends through the rotor pin 29 (not specifically depicted in FIG. 15). As should be readily understood, the current-conductive coil 15 functions to receive current and thereby creates a magnetic field as further depicted and referenced at vectors 102 in FIG. 15. As may be seen from an inspection of the noted figure, the magnetic field 102 is directed through the yoke termini 20 via the rotor assembly (essentially defined by the rotor bracket 26, the rotor magnets 23, and the rotor plate 25) for imparting armature or bridge rotation about the armature axis of rotation 101 via a magnetically induced torque.

The rotor bracket 26 thus functions to linearly displace the actuator arms 22 such that the first actuator arm is pulled and the second actuator arm is pushed. The displaced actuator arms 22 function to actuate the triumvirate spring assemblies 33 from a preferred spring-biased open position (as generally depicted in FIG. 4) to a spring-actuated closed position (as generally depicted in FIG. 2). The material construction of the relay assembly 10 (believed to be within the purview of those skilled in the art) and the closed position essentially function to enable 120-amp current to pass through the switch assemblies 14 via the contact buttons 34 and 37 and the switch termini 11.

When the coil assembly 12 is currently dormant and the magnetic field is effectively removed, it is contemplated that a return spring may well function to enhance return of the triumvirate spring assembly 33 to the preferred spring-biased open position. Should a fault current condition arise, it is contemplated that the electromagnetic relay 10 may preferably further comprise certain closed contact default means, the closed contact default means for forcing the contact buttons 34 and 37 closed during said fault current or short circuit condition(s). In this regard, it is contemplated that the path followed by the Lorenz current or magnetic field path as generally depicted in FIG. 15 by vector arrows 102.

It is further contemplated that the electromagnetic relay according to the present invention may comprise certain means for defaulting to an open contact position during threshold terminal-based current conditions. In this regard, it is noted from classical electromagnetic theory that streaming charge carriers develop a magnetic field in radial adjacency to the direction of the carrier stream. The reader is thus directed to FIG. 17 which is a diagrammatic depiction of a threshold current path as at 71 being directed through the relay terminals 31 and 32 via the contact buttons 34 and 37. A magnetic force vector as at 103 is depicted as terminal-sourced via the charge carrier current flowing through the path 71. After reaching certain threshold amperage, the magnetic field generated through the terminals 31 and 32 will interact with the permanent magnets or rotor magnets 23 of the rotatable armature assembly 13. The magnets 23 have an inherent magnetic field directed outward as referenced at vector arrow 104, the force of which is lesser in magnitude than the force at vector arrow 103. The difference in force between 104 and 103 as directed causes the rotatable armature assembly 13 to rotate toward an open contact position as further diagrammatically shown in FIG. 17. This feature can be calibrated by the size and strength of the magnets 23 and the distance between the armature and stationary contacts.

While the above descriptions contain much specificity, this specificity should not be construed as limitations on the scope of the invention, but rather as an exemplification of the invention. For example, the invention may be said to essentially teach or disclose an two-pole electromagnetic relay assembly for enabling current to pass through switch termini, which electromagnetic relay assembly comprising a coil assembly, a bridge assembly, and two switch assemblies. The coil assembly comprises a coil, a coil axis, and a C-shaped core. The coil is wound around its coil axis, and the coil axis extends through the core 60 in FIG. 15. The core 60 comprises core termini 20, which core termini 20 are substantially parallel to the coil axis.

The bridge assembly comprises an axis of rotation as at 101 and a bridge as at 61 in FIG. 15; and switch actuators as at 22. The bridge 61 comprises a medial field pathway 63 (i.e. a pathway relatively closer in proximity to the core 60), a lateral field pathway 64 (i.e. a pathway relatively further in proximity to the core 60), and axially spaced transverse pathways 65 for guiding the field as at 102 intermediate the medial and lateral field pathways 63 and 64. The actuator arms 22 are cooperable with, and extend away from, the lateral pathway 64 (not specifically depicted in FIG. 15). The core termini 20 are preferably coplanar with the axis of rotation 101 and received intermediate the medial and lateral pathways 63 and 64.

It is contemplated that the transverse pathways 65 provide certain field-diversion means for transversely diverting the magnetic field 102 relative to the coil axis and magnetically inducing a torque, which magnetically induced torque functions to actuate (push-pull) the switch actuators 22. Said field diversion means may be further described as comprising certain field division means (there being two axis-opposing paths as at 66 in FIG. 15) for creating a magnetic couple about the magnetically induced torque.

The switch assemblies 14 are further cooperable with the actuator arms 22, which actuator arms 22 are essentially a coupling intermediate the bridge assembly 61 and the switch assemblies 14. The coil 15 functions to create or impart a magnetic field as vectorially depicted at 102. The magnetic field 102 is directable through the bridge assembly 61 via the core termini 20 for imparting bridge rotation about the axis of rotation 101 via magnetically induced torque. The bridge rotation functions to displace the actuator arms 22, which displaced actuator arms 22 physically open and close the switch assembly 14. As is most readily understood in the arts, the closed switch assembly 14 enables current to pass therethrough.

The switch assemblies 14 comprise certain spring means for enhancing spring over travel, said means for enhancing the closed switch position by way of increasing the contact pressure intermediate contact buttons 34 and 37. The spring means for enhancing spring over travel further provide contact wiping means, and vibration damping means. The contact wiping means are contemplated to effectively self-cleanse the switch assemblies 14, and the vibration damping means function to damp contact vibration when switching from open to closed switch positions. The spring means for enhancing spring over travel may thus be said to enhance the closed switch position by increasing contact pressure intermediate the contacts, by maintaining a residue free contact interface, and by damping contact vibration when closing the contacts. The electromagnetic relay 10 thus enables current to pass through switch termini, and essentially a coil assembly, a rotatable bridge assembly, and first and second switch assemblies. The coil assembly operates to create a temporary coil-emanating magnetic field. The rotatable bridge assembly comprises opposing switch actuators and positions a permanent bridge-based magnetic field. The first and second switch assemblies are cooperable with the switch actuators such that when the coil-emanating magnetic field is directed through the bridge assembly, the same imparts bridge rotation (as at 82 in FIG. 3) via the bridge-based magnetic field. The bridge rotation displaces the switch actuators for opening and closing the switch assemblies. A first switch actuator pull-closes a first switch assembly as depicted at vector arrow 80 in FIGS. 3 and 19, and a second switch actuator push-closes a second switch assembly as depicted at vector arrow 81 in FIGS. 3 and 18.

The relay 10 thus provides a fully balanced motor assembly because the two contact systems are essentially situated in opposing directions to one another. This means the spring forces of one contact system are pointing toward the coil, and the other contact system has the forces pointing away from the coil. Since these contact systems are identical, the forces are automatically balanced. It should be further recalled that the relay is operational without the cover. A rotor mount on top of the coil assembly operates to fix the rotor into place. This allows the relay to be tested and operated without its cover on. The Lorentz current path withstands fault current conditions. The current path has been reversed within the relay so that the magnetic forces incurred during a fault or short circuit condition will force the contacts closed instead of open. Certain of the C-shaped cut outs around the contact buttons allow the armatures to have more over travel, which over travel has the following exemplary effects: increased contact pressure; increased contact wiping (i.e. since there is more contact pressure, the contacts will rub against one another wiping away any debris or burn residue); and reduced contact bounce when closing the contacts.

Although the invention has been described by reference to a number of embodiments it is not intended that the novel device or relay be limited thereby, but that modifications thereof are intended to be included as falling within the broad scope and spirit of the foregoing disclosure and the appended drawings. For example, the foregoing specifications support an electromagnetic relay assembly primarily intended for use as a double pole, 200-amp to 250-amp passing relay assembly. It is contemplated, however, that the essence of the invention may be applied in other similarly constructed relay assemblies, having unique utility in their own right, and which are enabled by the teachings of the two-pole embodiment set forth in this disclosure.

We claim:

1. An electromagnetic relay, the electromagnetic relay for enabling current to pass through switch termini, the electromagnetic relay comprising:

an electromagnetic coil assembly, the coil assembly comprising a coil, a C-shaped yoke assembly, and a coil axis, the coil being wound around the coil axis, the yoke assembly comprising first and second yoke arms, the yoke arms each comprising an axial yoke portion and a yoke terminus;

an armature bridge assembly, the armature bridge assembly comprising a bridge axis of rotation, a bridge, and opposing actuator arms, the bridge comprising a medial field pathway, a zigzagged lateral field pathway, and longitudinally spaced transverse field pathways, the actuator arms extending from terminal portions of the lateral field pathway; and two switch assemblies, the switch assemblies each comprising switch terminals and a spring assembly, the spring assemblies being attached to the actuator arms and extending intermediate the switch terminals, the yoke termini being received intermediate the medial and lateral field pathways, the bridge axis of rotation being coplanar with the yoke termini, the actuator arms and zigzagged lateral field pathway extending non-radially relative to the bridge axis of rotation, the coil for receiving current and creating a magnetic field, the magnetic field being directable through the bridge assembly via the yoke termini for imparting bridge rotation about the bridge axis of rotation and displacing the actuator arms, the displaceable actuator arms for actuating the spring assemblies intermediate an open contact position and a closed contact position, the closed contact position for enabling current to pass through the switch assemblies via the switch termini.

2. The electromagnetic relay of claim 1 comprising spring-based aperture means for enhancing spring over travel, said means for increasing contact pressure intermediate the switch terminals when the spring assemblies are in the closed contact position.

3. The electromagnetic relay of claim 2 wherein the spring-based aperture means for enhancing spring over travel provide means for contact wiping, said contact wiping means for cleansing the switch terminals.

4. The electromagnetic relay of claim 1 comprising spring-based aperture means for damping contact vibration intermediate the first and second contacts when switching from the open contact position to the closed contact position.

5. The electromagnetic relay of claim 1 comprising bridge-mounting means, the bridge-mounting means for enabling open face operation of the electromagnetic relay.

6. The electromagnetic relay of claim 1 comprising means for defaulting to a closed contact position during fault current conditions.

7. The electromagnetic relay of claim 1 comprising means for defaulting to an open contact position during threshold terminal-based current conditions.

8. An electromagnetic relay, the electromagnetic relay for enabling current to pass through switch termini, the electromagnetic relay comprising:

a coil assembly, the coil assembly comprising a coil, a coil axis, and a C-shaped core, the coil being wound round the coil axis, the coil axis extending through the core, the core comprising core termini, the core termini being parallel to the coil axis;

a bridge assembly, the bridge assembly comprising an axis of rotation, a bridge, and opposing actuators, the bridge comprising a medial field pathway, a zigzagged lateral field pathway, and spaced transverse field pathways, the actuators extending from terminal portions of the lateral field pathway, the core termini being coplanar with the axis of rotation and received intermediate the medial and lateral field pathways; and first and second switch assemblies cooperable with the actuators, the coil for creating a magnetic field, the magnetic field being directable through the bridge assembly via the core termini for imparting bridge rotation about the axis of rotation via magnetically induced torque, the bridge rotation for displacing the actuators, the displaceable actuators for opening and closing the switch assemblies, the closed switch assemblies for enabling current to pass therethrough.

9. The electromagnetic relay of claim 8 wherein the switch assemblies comprise spring-based aperture over travel means for enhancing spring over travel and for enhancing the closed switch position.

10. The electromagnetic relay of claim 9 wherein the spring-based aperture over travel means provide contact wiping means, said contact wiping means for cleansing the switch assemblies.

11. The electromagnetic relay of claim 8 comprising spring-based aperture damping means for damping switch vibration when switching from open to closed switch positions.

12. The electromagnetic relay of claim 8 comprising bridge-mounting means, the bridge-mounting means for enabling open face operation of the electromagnetic relay.

13. The electromagnetic relay of claim 8 comprising means for defaulting to a closed contact position during fault current conditions.

14. The electromagnetic relay of claim 8 comprising means for defaulting to an open contact position during threshold terminal-based current conditions.

15. The electromagnetic relay of claim 9 wherein the switch assemblies each comprise a spring assembly, the spring assemblies each comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configure providing the spring-based aperture means for enhancing spring over travel.

16. The electromagnetic relay of claim 11 wherein the switch assemblies each comprise a spring assembly, the spring assemblies each comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configured providing the spring-based aperture means for damping contact vibration.

17. An electromagnetic relay, the electromagnetic relay for enabling current to pass through switch termini, the electromagnetic relay comprising:

a coil assembly, the coil assembly for selectively creating a coil-emanating magnetic field;

a rotatable bridge assembly, the bridge assembly comprising opposing switch actuators and a bridge-based magnetic field; and first and second switch assemblies cooperable with the switch actuators, the coil-emanating magnetic field being directable through the bridge assembly for imparting bridge rotation via the bridge-based magnetic field, the bridge rotation for displacing the switch actuators about a bridge axis of rotation, the displaceable switch actuators for opening and closing the switch assemblies, the closed switch assemblies for enabling current to pass therethrough;

wherein the switch assemblies comprise spring-based aperture over travel means for enhancing spring over travel and for enhancing the closed switch position; wherein the switch assemblies each comprise a spring assembly, the spring assemblies each comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configured providing the spring-based aperture means for enhancing spring over travel.

18. An electromagnetic relay, the electromagnetic relay for enabling current to pass through switch termini, the electromagnetic relay comprising:

a coil assembly, the coil assembly for selectively creating a coil-emanating magnetic field; a rotatable bridge assembly, the bridge assembly comprising opposing switch actuators and a bridge-based magnetic field; and first and second switch assemblies cooperable with the switch actuators, the coil-emanating magnetic field being directable through the bridge assembly for imparting bridge rotation via the bridge-based magnetic field, the bridge rotation for displacing the switch actuators about a bridge axis of rotation, the displaceable switch actuators for opening and closing the switch assemblies, the closed switch assemblies for enabling current to pass therethrough; and spring-based aperture damping means for damping switch vibration when switching from open to closed switch positions;

wherein the switch assemblies each comprise a spring assembly, the spring assemblies each comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configured providing the spring-based aperture means for damping contact vibration.

19. An electromagnetic relay, the electromagnetic relay for enabling current to pass through switch termini, the electromagnetic relay comprising:

a coil assembly, the coil assembly comprising a current-conductive coil and a coil axis, the coil for creating a magnetic field;

an armature assembly, the armature assembly comprising switch actuators, a zigzagged rotor bracket having opposing actuator-engaging structures, and field-diversion means, the field-diversion means for transversely diverting the magnetic field relative to the coil axis and magnetically inducing a torque, the magnetically induced torque for actuating the switch actuators via the actuator-engaging structures; and first and second switch assemblies, the switch actuators being cooperable with the switch assemblies for enabling current to pass therethrough, wherein the first and second switch assemblies each comprising spring-based aperture, means for damping switch vibration when switching from open to closed switch positions; wherein each switch assembly comprises a spring assembly, the spring assemblies each comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configured providing the spring-based aperture means for damping contact vibration.

20. The electromagnetic relay of claim 2 wherein the switch assemblies each comprise a spring assembly, the spring assemblies each comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such tat the first, second and third semi-circular aperture-defining extensions are uniformly stacked, the three spring elements so configured providing the spring-based aperture means for enhancing spring over travel.

21. The electromagnetic relay of claim 4 wherein the switch assemblies each comprise a spring assembly, the spring assemblies each comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of die three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configured providing the spring-based aperture means for damping contact vibration.

22. The electromagnetic relay of claim 1 wherein the actuator arms simultaneously and respectively pull-close and push-close the switch assemblies for enabling current to pass therethrough.

23. The electromagnetic relay of claim 8 wherein the actuator arms simultaneously and respectively pull-close and push-close the switch assemblies for enabling current to pass therethrough.

* * * * *